US010641504B2

(12) United States Patent
Xue et al.

(10) Patent No.: US 10,641,504 B2
(45) Date of Patent: May 5, 2020

(54) AIR-CONDITIONER OUTDOOR DEVICE AND AIR-CONDITIONER UNIT

(71) Applicants: Gree Electric Appliances (Wuhan) Co., Ltd., Wuhan (CN); Gree Electric Appliances, Inc. of Zhuhai, Zhuhai (CN)

(72) Inventors: Handong Xue, Zhuhai (CN); Kai Yu, Zhuhai (CN); Youfu Xie, Zhuhai (CN)

(73) Assignee: Gree Electric Appliances (Wuhan) Co., Ltd., Wuhan (CN)

( * ) Notice: Subject to any disclaimer, the term of this patent is extended or adjusted under 35 U.S.C. 154(b) by 0 days.

(21) Appl. No.: 15/768,862

(22) PCT Filed: Mar. 8, 2018

(86) PCT No.: PCT/CN2018/078440
§ 371 (c)(1),
(2) Date: Apr. 17, 2018

(87) PCT Pub. No.: WO2019/127907
PCT Pub. Date: Jul. 4, 2019

(65) Prior Publication Data

US 2019/0195517 A1 Jun. 27, 2019

(30) Foreign Application Priority Data

Dec. 26, 2017 (CN) ..... 2017 1 1428809

(51) Int. Cl.
*F24F 1/52* (2011.01)
*F24F 1/10* (2011.01)
(Continued)

(52) U.S. Cl.
CPC ..... *F24F 1/52* (2013.01); *F24F 1/10* (2013.01); *F24F 1/16* (2013.01); *F24F 1/30* (2013.01);
(Continued)

(58) Field of Classification Search
CPC ..... F24F 1/62; F24F 1/56; F24F 1/00; F24F 1/52; F24F 1/32
See application file for complete search history.

(56) References Cited

U.S. PATENT DOCUMENTS

2009/0044554 A1* 2/2009 Takeichi ..... F24F 1/26 62/259.1

FOREIGN PATENT DOCUMENTS

CN 2388528 Y 7/2000
CN 101592370 A 12/2009
(Continued)

OTHER PUBLICATIONS

Translation CN101592370.*

*Primary Examiner* — Elizabeth J Martin
(74) *Attorney, Agent, or Firm* — The Webb Law Firm

(57) ABSTRACT

An air-conditioner outdoor device and an air-conditioner unit are provided. The air-conditioner outdoor device includes a casing and a heat exchanger, wherein the heat exchanger is disposed within the casing, a front plate of the casing is provided with an air outlet and two air inlets, the air outlet is located between the two air inlets, the heat exchanger is positioned closer to the front plate relative to a rear plate of the casing and faces the air outlet, and air flow entering the casing from the air inlets flows out of the casing from the air outlet after flowing through the heat exchanger. The air-conditioner unit comprises the air-conditioner outdoor device. The air-conditioner outdoor device of the present application improves the air intake and outlet manners to facilitate the installation of the air-conditioner outdoor device in a mounting hole through a wall and indoors.

19 Claims, 5 Drawing Sheets

(51) Int. Cl.

| | |
|---|---|
| ***F24F 1/62*** | (2011.01) |
| ***F24F 1/30*** | (2011.01) |
| ***F24F 1/56*** | (2011.01) |
| ***F24F 1/16*** | (2011.01) |
| ***F24F 1/46*** | (2011.01) |
| ***F24F 1/60*** | (2011.01) |

(52) U.S. Cl.
CPC ..... *F24F 1/46* (2013.01); *F24F 1/56* (2013.01); *F24F 1/60* (2013.01); *F24F 1/62* (2013.01)

(56) References Cited

FOREIGN PATENT DOCUMENTS

| | | | |
|---|---|---|---|
| CN | 104534574 | A | 4/2015 |
| CN | 106918083 | A | 7/2017 |
| CN | 106979564 | A | 7/2017 |
| CN | 207815532 | U | 9/2018 |
| KR | 1020070078662 | A | 8/2007 |
| KR | 1020070095575 | A | 10/2007 |

* cited by examiner

AIR-CONDITIONER OUTDOOR DEVICE AND AIR-CONDITIONER UNIT

CROSS-REFERENCE TO RELATED APPLICATIONS

This application is the United States national phase of International Application No. PCT/CN2018/078440 filed Mar. 8, 2018, and claims priority to Chinese Patent Application No. 201711428809.4 filed Dec. 26, 2017, the disclosures of which are hereby incorporated in their entirety by reference.

BACKGROUND OF THE INVENTION

Field of the Invention

The present application relates to the technical field of air conditioning, and especially relates to an air-conditioner outdoor device and an air-conditioner unit.

Description of Related Art

In the prior art, most of the air-conditioner outdoor devices (such as an air-conditioner outdoor device of a household Variable refrigerant Flow) are installed at such places as a preset air-conditioner installation location outside a wall of the building or a roof. When the outside of the wall is not provided with or cannot be provided with an air-conditioner installation location and there is a distance far from the roof, the air-conditioner outdoor device can only be installed on the wall or indoors. However, as it is difficult to install the air-conditioner outdoor device in a mounting hole in the wall and indoors by the air intake and outlet manners of the existing air-conditioner outdoor devices, it is necessary to improve the air intake and air outlet manner of the air-conditioner outdoor device.

SUMMARY OF THE INVENTION

The object of the present application is to provide an air-conditioner outdoor device and an air-conditioner unit to improve the air intake and outlet manners of the air-conditioner outdoor device to facilitate the installation of the air-conditioner outdoor device in a mounting hole through the wall and indoors. It may also make a more reasonable air intake and air outlet, and a better heat exchange effect.

In order to achieve the aforementioned object, the present application provides an air-conditioner outdoor device, which comprises: a casing, a front plate of which is provided with two air inlets and one air outlet between the two air inlets; and a heat exchanger, located at a position within the casing closer to the front plate relative to a rear plate of the casing and facing to the air outlet, such that air flow entering the casing from the air inlets flows out of the casing from the air outlet after flowing through the heat exchanger.

In some embodiments, the air outlet and the two air inlets are arranged in a longitudinal direction.

In some embodiments, an air inlet space is formed at both lateral sides and a rear side of the heat exchanger, and an air outlet space is formed between a front side of the heat exchanger and the front plate of the casing, wherein the air inlets communicate with the air inlet space, and the air outlet communicates with the air outlet space.

In some embodiments, the dimension in a longitudinal direction is greater than the dimension in a vertical direction of the air-conditioner outdoor device.

In some embodiments, the casing is configured to be at least partially installed within a wall, and the front plate of the casing is configured to be substantially flush with an outer surface of the wall.

In some embodiments, the air-conditioner outdoor device comprises a support frame, wherein the casing comprises a portion for being installed within the wall and the other portion for being located indoors, and the portion located indoors is supported by the support frame.

In some embodiments, the air-conditioner outdoor device further comprises a partition plate, which partitions an inner space of the casing into a front space and a rear space, wherein the heat exchanger is disposed within the front space.

In some embodiments, the air-conditioner outdoor device comprises a fan provided within the front space, wherein the fan is located at a rear side of the heat exchanger to drive air flow to enter into the front space from the air inlets and blow the air flow towards the heat exchanger; or, the fan is located at a front side of the heat exchanger to suck the air flow entering the front space from the air inlets, so that the air flow flows through the heat exchanger and flows out of the casing from the air outlet.

In some embodiments, the air-conditioner outdoor device comprises a partition plate, which partitions an inner space of the casing into a front space and a rear space, wherein a top cover of the casing comprises a front top cover and a rear top cover, and the front top cover is covered over the front space, the rear top cover is covered over the rear space, and at least the rear top cover is openable independently.

In some embodiments, the air-conditioner outdoor device comprises a partition plate, which partitions an inner space of the casing into a front space and a rear space, wherein the air-conditioner outdoor device comprises a valve for connecting the air-conditioner outdoor device and an air-conditioner indoor device, the valve is disposed on a lateral plate of the casing, the partition plate comprises a first plate portion and a second plate portion connected to one side of the first plate portion adjacent to the valve, the second plate portion extends obliquely from the first plate portion toward a front side and is connected to the lateral plate, and the valve is disposed adjacent to the front plate of the casing and located behind a connection part of the second plate portion and the lateral plate.

In some embodiments, the air-conditioner outdoor device further comprises a compressor and an electrical box assembly, wherein the compressor is disposed within the rear space and/or the electrical box assembly is disposed within the rear space.

In order to realize the aforementioned object, the present application further provides an air-conditioner unit, which comprises an air-conditioner indoor device and the aforementioned air-conditioner outdoor device.

In order to realize the aforementioned object, the present application further provides a building, which comprises: a wall; and the air conditioner, wherein the casing is at least partially installed within the wall, and the front plate of the casing is substantially flush with an outer surface of the wall.

In some embodiments, the building comprises a support frame, wherein a portion of the casing is installed within the wall and another portion of the casing is located indoors, the portion located indoors being supported by the support frame.

Based on the aforementioned technical solution, in the embodiments of the air-conditioner outdoor device of the present application, first of all, the air inlet and the air outlet are both disposed on the front plate of the casing, so that during the installation, the purpose of installing the air-conditioner outdoor device in a mounting hole through the wall and indoors may be achieved by directing the front plate towards the outdoor. Next, the front plate is provided with an air outlet and two air inlets, and the air outlet is located between the two air inlets so that the air flow may intake air from both sides and blast from the middle, to make a more uniform flow field when the air flow passes through the heat exchanger, and be favorable for improving the heat exchange efficiency.

BRIEF DESCRIPTION OF THE DRAWINGS

The drawings described herein are used to provide a further understanding of the present application and constitute a part of the present application. The illustrative embodiments of the present application as well as the descriptions thereof, which are used for explaining the present application, do not constitute improper definitions on the present application. In the drawings.

DESCRIPTION OF THE INVENTION

Figure 1:
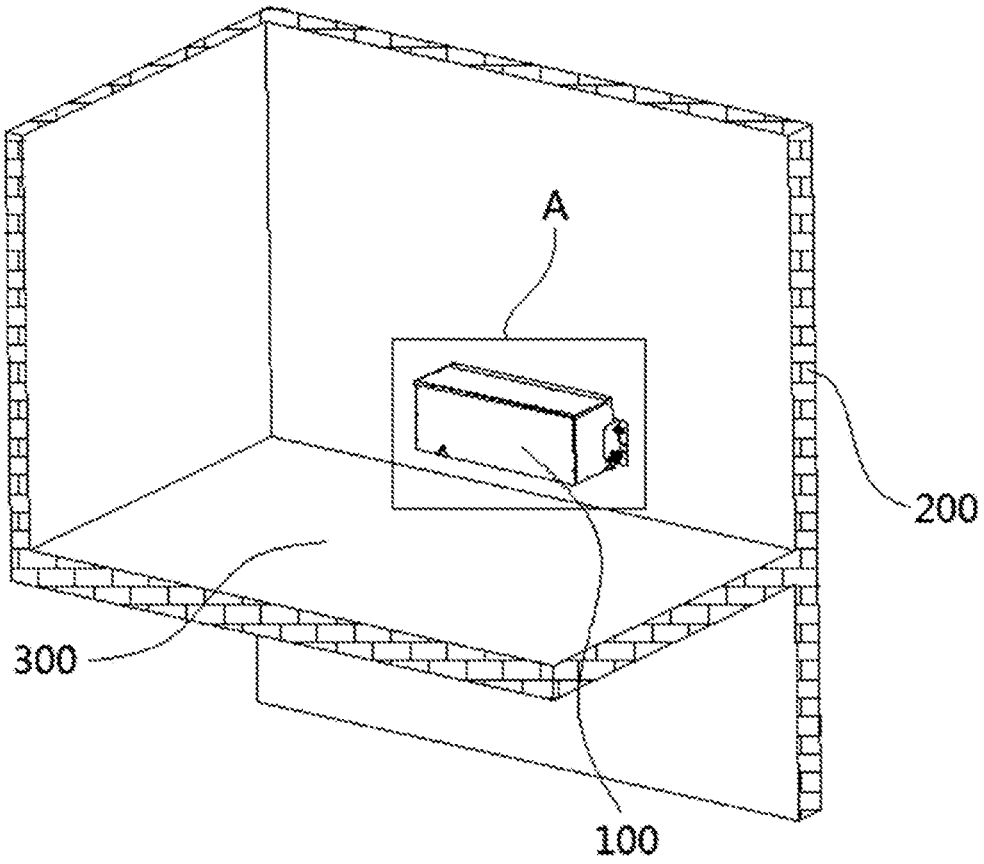
FIG. 1 is a schematic view of the structure of one embodiment of the air-conditioner outdoor device of the present application installed in a mounting hole through the wall in one direction.

Next, the technical solution in the embodiments will be explicitly and completely described in combination with the drawings in the embodiments of the present application. Apparently, the described embodiments are merely part of the embodiments of the present application, rather than all the embodiments. On the basis of the embodiments of the present application, all the other embodiments acquired by a person skilled in the art on the premise that no inventive effort is involved fall into the protection scope of the present application.

In the description of the present application, it is necessary to understand that, the azimuth or positional relations indicated by the terms "center", "transverse", "longitudinal", "front", "rear", "left", "right", "up", "down", "vertical", "horizontal", "top", "bottom", "within", "outside", which are based on the azimuth or positional relations illustrated by the drawings, are only for facilitating description of the present application and simplifying the description, rather than indicating or implying that the device or element referred to has to present a particular azimuth, and be constructed and operated in a particular azimuth, so that it cannot be understood as limiting the protection scope of the present application.

FIGS. 1 to 5 show the structure of the air-conditioner outdoor device 100 of the embodiments of the present application and a mounting structure installed on a wall by penetrating therethrough.

As shown in FIGS. 1 to 5, in an illustrative embodiment of the air-conditioner outdoor device provided by the present application, the air-conditioner outdoor device 100 comprises a casing 110 and a heat exchanger 170, wherein the heat exchanger 170 is disposed within the casing 110, and a front plate 111 of the casing 110 is provided with an air outlet 1111 and two air inlets (a first air inlet 1112 and a second air inlet 1113). The air outlet 1111 is located between the first air inlet 1112 and the second air inlet 1113. The heat exchanger 170 is disposed at a position closer to the front plate 111 relative to a rear plate of the casing 110 and facing to the air outlet 1111. Air flow entering the casing 110 from the first air inlet 1112 and the second air inlet 1113 flows out of the casing 110 from the air outlet 1111 after flowing through the heat exchanger 170.

In the aforementioned illustrative embodiment, first of all, the first air inlet 1112, the second air inlet 1113 and the air outlet 1111 are disposed on the front plate 111 of the casing 110, so that during the installation, the purpose of installing the air-conditioner outdoor device 100 in a mounting hole through the wall and indoors may be achieved by directing the front plate 111 towards the outdoor, so as to meet the requirement that the air-conditioner outdoor device 100 is not externally hanged and prevent the air-conditioner outdoor device 100 from accidentally falling off. Next, the front plate 111 is provided with an air outlet 1111, a first air inlet 1112 and a second air inlet 1113, and the air outlet 1111 is located between the first air inlet 1112 and the second air inlet 1113 so that the air flow may intake air from both sides and blast from the middle, to make a more uniform flow field when the air flow passes through the heat exchanger 170, and be favorable for improving the heat exchange efficiency.

The embodiments of the present application further provide an air-conditioner unit, which comprises an air-conditioner indoor device and the air-conditioner outdoor device of the embodiments of the present application, so as to present all the advantages possessed by the air-conditioner outdoor device.

The embodiments of the present application will be further described in detail in combination with FIGS. 1 to 5.

The air-conditioner outdoor device 100 of the present embodiment comprises a casing 110, a heat exchange system 120 (comprising a heat exchanger 170 and a fan), a partition wall 130, an electrical box assembly 140, a compressor 150, and a line 160.

Figure 2:
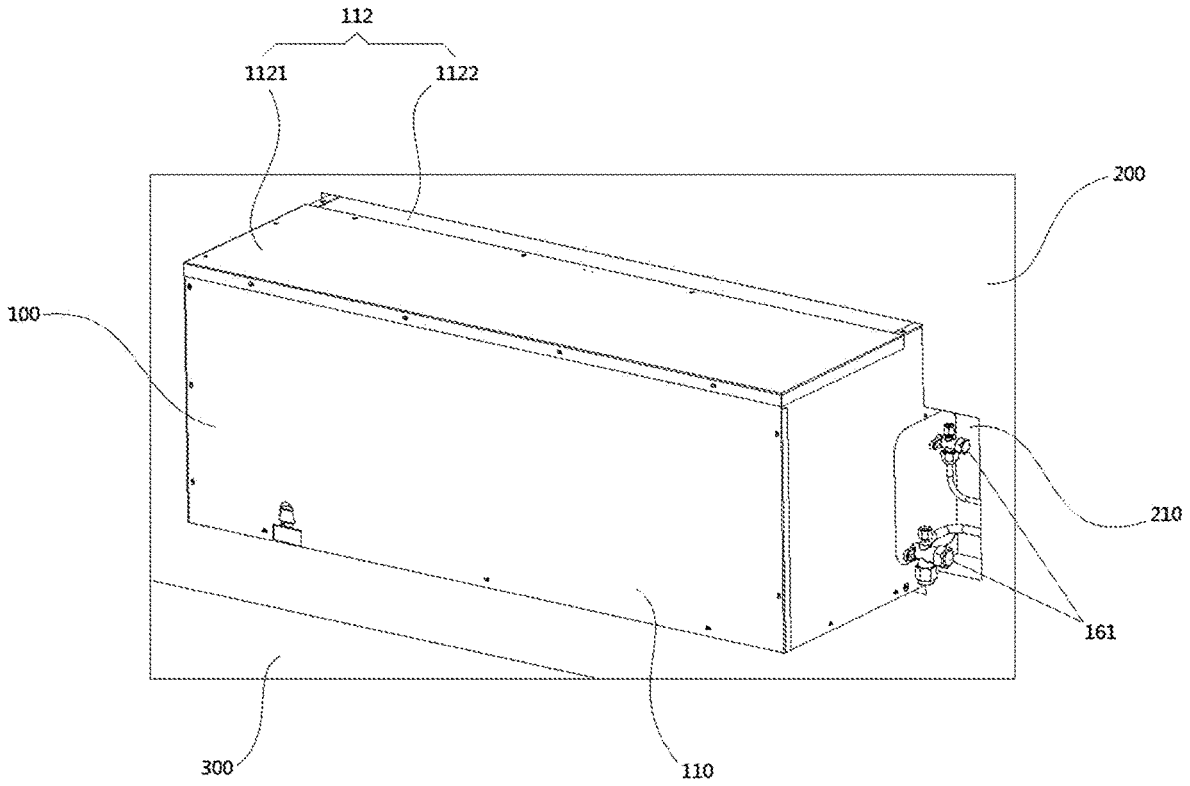
FIG. 2 is an enlarged schematic view of the structure of the portion A of FIG. 1.
Figure 3:
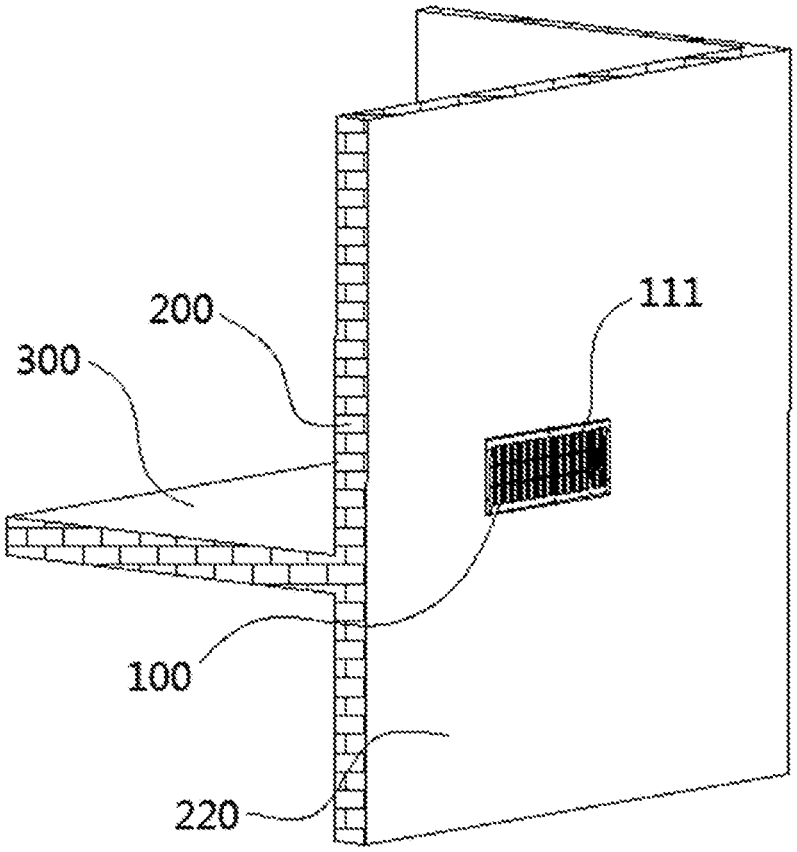
FIG. 3 is a schematic view of the structure of one embodiment of the air-conditioner outdoor device of the present application installed in a mounting hole through the wall in another direction.

As shown in FIGS. 1 to 3, the air-conditioner outdoor device 100 is installed on the wall 200 of the building by penetrating the wall. Preferably, the casing 110 is at least partially installed within a wall 200, and the front plate 111 of the casing 110 is substantially flush with an outer surface 220 of the wall 200, which meets the requirement that the air-conditioner outdoor device cannot be externally hanged in some countries and regions. The air-conditioner outdoor device 100 is installed by penetrating through the wall. Since there is certain distance of extension into the wall in the wall's thickness direction, as long as the wall thickness and the support capability are sufficient, it may be fully supported directly by the wall without provision of an additional support member or support on the ground 300. If the air-conditioner outdoor device 100 is provided with certain spacing from the ground 300, it is advantageous for the air-conditioner outdoor device 100 to better radiate heat.

For the sake of safety, the air-conditioner outdoor device 100 further comprises a support frame, wherein when a portion of the casing 110 is installed within the wall 200, and the other portion is located indoors, and there is certain distance from the casing 110 to the ground 300, the portion located indoors is supported by the support frame. The safety and stability of the air-conditioner outdoor device 100 may be effectively ensured by providing the support frame.

Figure 4:
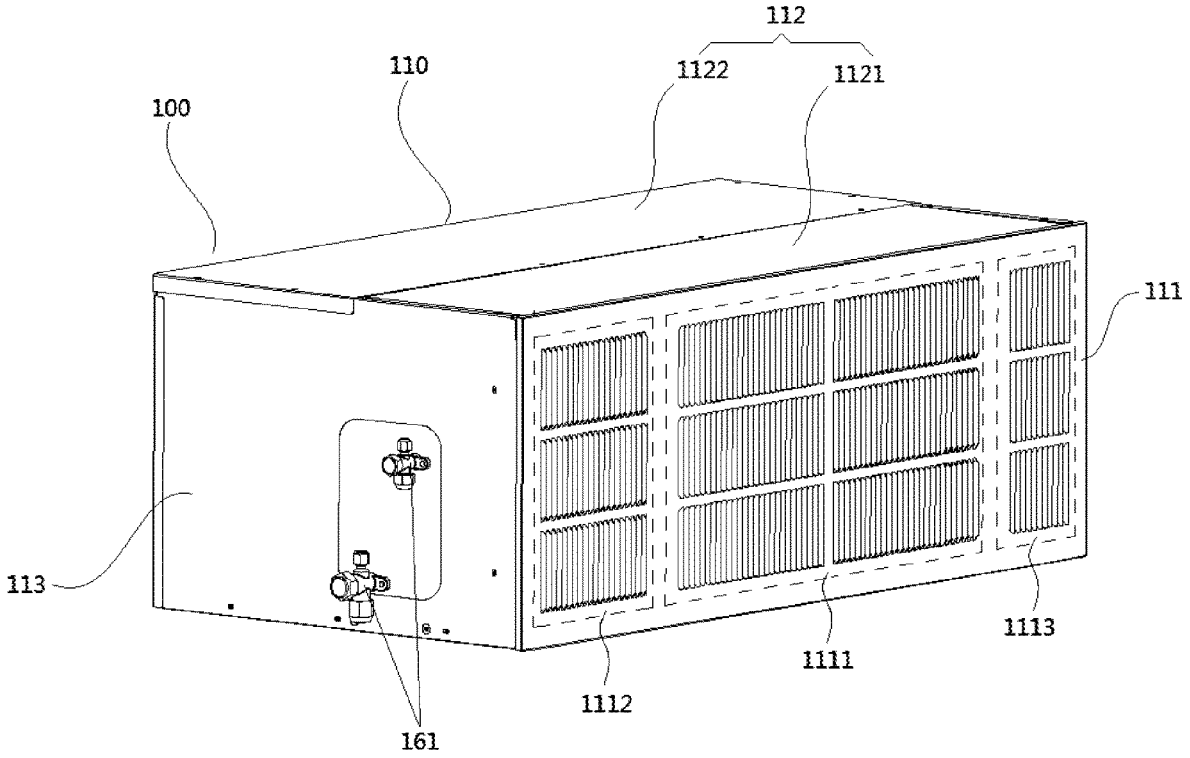
FIG. 4 is a schematic view of a three-dimensional structure of one embodiment of the air-conditioner outdoor device of the present application.

As shown in FIG. 4, the air outlet 1111, the first air inlet 1112 and the second air inlet 1113 are arranged in a longitudinal direction (left-right direction). The advantage of such provision is that, when the air-conditioner outdoor device 100 is installed in a mounting hole through the wall, relative to the vertical arrangement of the air outlet and the air inlet, said arrangement manner is favorable for providing the air-conditioner outdoor device 100 in a flat box shape having a dimension in a longitudinal direction greater than a dimension in a vertical direction, so as to increase a support area of the wall for the air-conditioner outdoor device 100, so that there is better stability in installing the air-conditioner outdoor device 100, thereby also reducing the requirements for the support capability of the wall 200, and also favorable for reducing the auxiliary support and simplifying the installation.

The air outlet 1111, the first air inlet 1112 and the second air inlet 1113 may be provided with an air grill, which is conducive to the organization of the air flow on the one hand, and beneficial to the appearance of the wall 200 on the other hand.

In some alternative embodiments, an air inlet space IS is formed at both lateral sides and a rear side of the heat exchanger 170, and an air outlet space OS is formed between a front side of the heat exchanger 170 and the front plate 111 of the casing 110. The first air inlet 1112 and the air inlet 1113 communicate with the air inlet space IS, and the air outlet 1111 communicates with the air outlet space OS. In this way, the air flow may pass through both lateral sides of the heat exchanger 170 and bypass to a rear side of the heat exchanger 170, and then flow out through an air outlet at the front side of the heat exchanger 170 after passing through the heat exchanger 170, so that there is a very uniform flow field when the air flow enters into and exits from the heat exchanger 170, and the heat exchange area of the heat exchanger 170 is raised so as to further improve the heat exchange efficiency.

Figure 5:
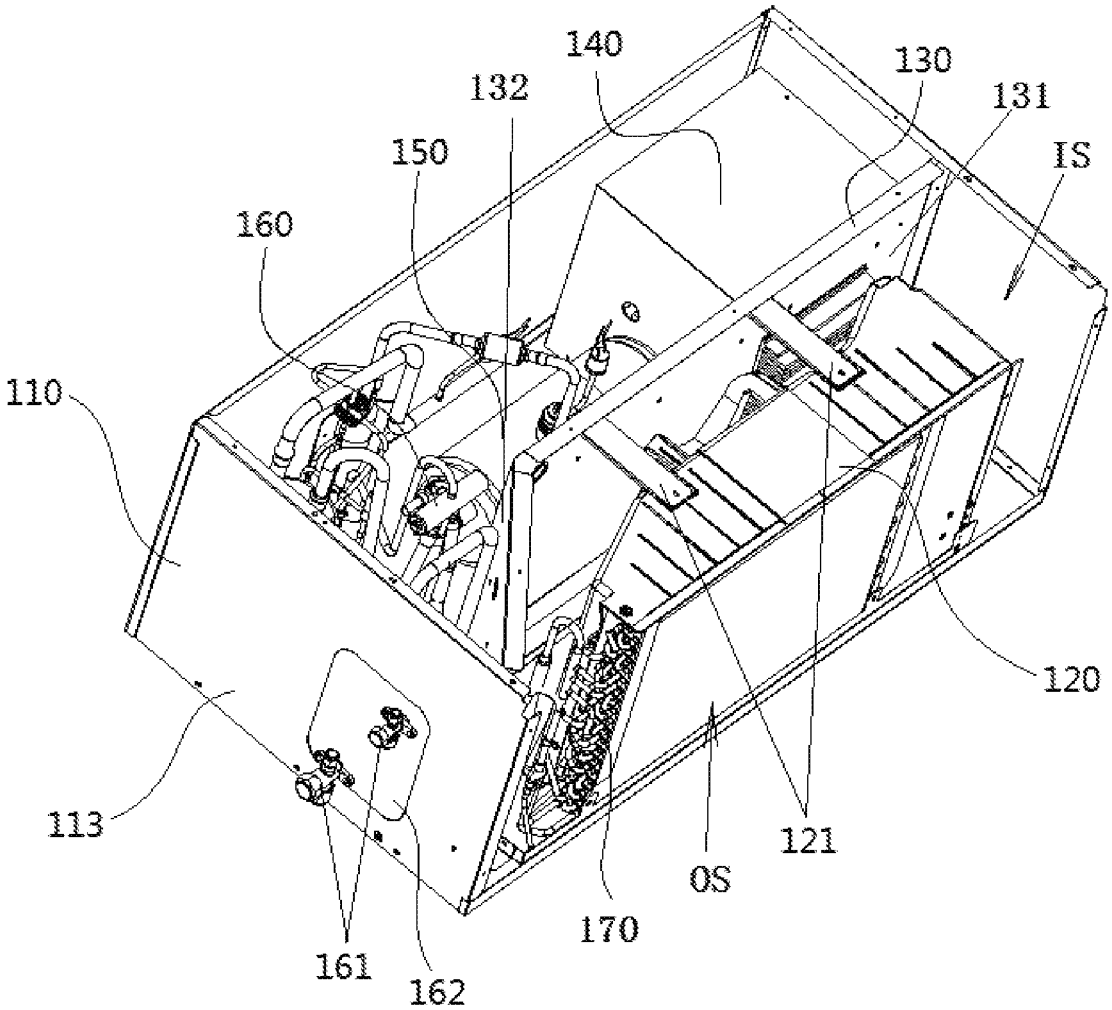
FIG. 5 is a schematic view of a three-dimensional structure of one embodiment of the air-conditioner outdoor device of the present application, in which a top cover and a front plate are removed.

As shown in FIGS. 4 and 5, the casing 110 which is square as a whole, comprises a bottom plate, a front plate 111, a rear plate, a left lateral plate 113, a right lateral plate, and a top cover 112.

As shown in FIGS. 1, 2 and 4, in the present embodiment, the top cover 112 comprises a front top cover 1121 and a rear top cover 1122. The front top cover 1121 is covered over the front space, and the rear top cover 1122 is covered over the rear space. Moreover, at least the rear top cover 1122 of the front top cover 1121 and the rear top cover 1122 is openable independently.

The above provision manner of the top cover 112 makes it possible to only open the rear top cover 1122 to perform relevant operations, without having to remove an entirety of the air-conditioner outdoor device 100 to perform repair or maintenance, so as to facilitate performing the repair and maintenance work, if the members within the rear space H-need to be repaired or maintained after the air-conditioner outdoor device 100 is installed by penetrating through the wall.

In the present embodiment, after the rear top cover 1122 is opened, the front top cover 1121 may be further opened. In some non-illustrated embodiments, the front top cover 1121 and the rear top cover 1122 may be respectively opened separately, or the rear top cover 1122 may be opened separately and may be opened together with the front top cover.

As shown in FIG. 5, the air-conditioner outdoor device 100 further comprises a partition plate 130, which partitions an inner space of the casing 110 into a front space and a rear space, wherein the heat exchanger 170 is disposed within the front space. The provision of the partition plate 130 allows the air flow to flow through the heat exchanger 170 in an organized manner to achieve the air intake and air outlet at the same side and a favorable heat exchange effect on one hand, and may reduce the transmission of the noise of the front space towards the indoor on the other hand.

After the provision of the partition plate 130, the heat exchanger 170 is disposed within the front space, and the front space may be partitioned by the heat exchanger 170 to form the above-mentioned air inlet space IS and air outlet space OS, so that the air inlet space IS communicates with the first air inlet 1112 and the second air inlet 1113, and the air outlet space OS communicates with the air outlet 1111. The provision allows an orderly and reasonable flow of the air into the front space to achieve adequate heat exchange with the heat exchanger 170.

The air-conditioner outdoor device 100 may further comprise a fan which may be provided within the front space and located at a rear side of the heat exchanger 170 to drive the air flow to enter into the front space from the first air inlet 1112 and the second air inlet 1113 and blow the air flow towards the heat exchanger 170 to form a blowing heat exchange; or, the fan may be disposed within the front space and located at a front side of the heat exchanger 170 to suck the air flow entering the front space from the first air inlet 1112 and the second air inlet 1113, so that the air flow flows through the heat exchanger 170 and flows out of the casing 110 from the air outlet 1111 to form a suction heat exchange.

The air-conditioner outdoor device 100 comprises a valve 161 for connecting the air-conditioner indoor device. As shown in FIG. 5, the two valves 161 are disposed on a left lateral plate 113 of the casing 110 through a valve bracket 162. In some non-illustrated embodiments, the valves 161 may also be disposed on a right lateral plate of the casing 110.

As shown in FIG. 5, the partition plate 130 comprises a first plate portion 131 provided to be spaced from the front plate 111, and a second plate portion 132 connected to one side of the first plate portion 131 adjacent to the valve 161. In the present embodiment, the first plate portion 131 is parallel to the front plate 111. The second plate portion 132 extends obliquely from the first plate portion 131 toward a front side and is connected to the lateral plate in which the valve 161 is located. The valve 161 is disposed adjacent to the front plate 111 of the casing 110 and located behind a connection part of the second plate portion 132 and the lateral plate. The provision makes it possible for the valve 161 to be conveniently connected to the line 160 inside the casing 110 on the one hand. On the other hand, it is suitable for concealing the connection line between the valve 161 and the air-conditioner indoor device inside the wall.

As shown in FIGS. 1 and 2, after the air-conditioner outdoor device 100 is installed in a mounting hole through the wall 200, part of the connection line between the valve 161 and the air-conditioner indoor device is also located within a mounting hole 210 in the wall 200. The valve 161 and the connection line may be concealed within the mounting hole 210 in such a manner as to provide a baffle plate, and the remaining portion of the connection line is concealed within the wall 200, so that the valve 161 and the connection line may be prevented from being exposed indoors, thereby favorable for protection and also favorable for maintaining an aesthetic indoor environment.

As shown in FIG. 5, the top ends of the front plate 111 and the partition plate 130 are connected with two connection plates 121 in a front-rear direction, which may connect the partition plate 130 and the heat exchange system 120. The heat exchange system 120 is internally provided with a heat exchanger 170 and a fan, and the connection plates 121 can improve the stability in installing the heat exchange system 120. In the present embodiment, the fan uses an axial flow fan. In the non-illustrated embodiments, the fan may also use a fan of other structures, such as a centrifugal fan and a cross flow fan.

The compressor 150 and the electrical box assembly 140 are disposed within the rear space. The electrical box assembly 140 and the compressor 150 are longitudinally arranged. As shown in FIG. 5, the compressor 150 is a horizontal compressor, with an axis arranged on the left side of the electrical box assembly 140 along a longitudinal direction. The electrical box assembly 140 is disposed on the right side. The line 160 is partially disposed within the rear space, and partially disposed within the front space according to the connection requirements of the system.

The air-conditioner outdoor device 100 of the above embodiments of the present application also has the advantages of simple, safe and reliable installation, low installation cost, and safe and convenient maintenance in the later period. During the installation, the air-conditioner outdoor device 100 is penetrated into the mounting hole 210 from the inside of the wall 200, and the front end of the air-conditioner outdoor device 100 is substantially flush with the outer surface 220 of the wall 200, and then the air-conditioner outdoor device 100 is fixed up, and connected to the air-conditioner indoor device so that the installation is quick and convenient. If the air-conditioner outdoor device 100 needs to be removed for repair, the rear top cover 1122 may be directly opened on the indoor side, or the air-conditioner outdoor device 100 may be withdrawn from the mounting hole 210 in the wall 200 on the indoor side. The air-conditioner outdoor device 100 is installed and removed from the inside of the wall, which can avoid the danger when the maintenance personnel perform aerial platform outside the wall.

Finally, it should be explained that: the aforementioned embodiments are only used to describe the technical solution of the present application rather than limiting the same; although detailed explanations are made to the present application by referring to preferred embodiments, a common technical person in the art should understand that: it is still possible to make amendments to the embodiments of the present application or make equivalent replacements to part of the technical features; without departing from the spirit and scope of the present application, they should all be covered in the scope of the technical solution for which protection is sought in the present application.

The invention claimed is:

1. An air-conditioner outdoor device, comprising:

a casing, a front plate of which is provided with two air inlets and one air outlet between the two air inlets; and a heat exchanger, located at a position within the casing closer to the front plate relative to a rear plate of the casing and facing the air outlet, such that air flow entering the casing from the two air inlets flows out of the casing from the air outlet after flowing through the heat exchanger;

wherein the air-conditioner outdoor device further comprises:

a partition plate, which partitions an inner space of the casing into a front space and a rear space; and a valve, for connecting the air-conditioner outdoor device and an air-conditioner indoor device, wherein the valve is disposed on a lateral plate of the casing; and wherein:

the partition plate comprises: a first plate portion, and a second plate portion connected to a side of the first plate portion adjacent to the valve;

the second plate portion extends obliquely from the first plate portion toward a front side and is connected to the lateral plate; and the valve is disposed adjacent to the front plate and located behind a connection part between the second plate portion and the lateral plate.

2. The air-conditioner outdoor device according to claim 1, wherein the air outlet and the two air inlets are arranged in a longitudinal direction.

3. The air-conditioner outdoor device according to claim 1, wherein an air inlet space is formed at both lateral sides and a rear side of the heat exchanger, and an air outlet space is formed between a front side of the heat exchanger and the front plate of the casing, and wherein the two air inlets communicate with the air inlet space, and the air outlet communicates with the air outlet space.

4. The air-conditioner outdoor device according to claim 1, wherein a dimension in a longitudinal direction of the air-conditioner outdoor device is greater than a dimension in a vertical direction of the air-conditioner outdoor device.

5. The air-conditioner outdoor device according to claim 1, wherein the casing is configured to be at least partially installed within a wall, and the front plate of the casing is configured to be substantially flush with an outer surface of the wall.

6. The air-conditioner outdoor device according to claim 5, further comprising a support frame, wherein the casing comprises a portion for being installed within the wall and another portion for being located indoors, the portion located indoors being supported by the support frame.

7. The air-conditioner outdoor device according to claim 1, wherein the heat exchanger is disposed within the front space.

8. The air-conditioner outdoor device according to claim 7, further comprising a fan provided within the front space, wherein the fan is located at a rear side of the heat exchanger to drive air flow to enter the front space from the two air inlets and blow the air flow towards the heat exchanger; or the fan is located at a front side of the heat exchanger to suck the air flow entering the front space from the two air inlets, so that the air flow flows through the heat exchanger and flows out of the casing from the air outlet.

9. The air-conditioner outdoor device according to claim 1, wherein a top cover of the casing comprises a front top cover and a rear top cover, and the front top cover covers the front space, the rear top cover covers the rear space, and at least the rear top cover is openable independently.

10. The air-conditioner outdoor device according to claim 7, further comprising a compressor and an electrical box assembly, wherein the compressor is disposed within the rear space and/or the electrical box assembly is disposed within the rear space.

11. An air-conditioner unit, comprising an air-conditioner indoor device and the air-conditioner outdoor device according to claim 1.

12. The air-conditioner unit according to claim 11, wherein the air outlet and the two air inlets are arranged in a longitudinal direction.

13. The air-conditioner unit according to claim 11, wherein an air inlet space is formed at both lateral sides and a rear side of the heat exchanger, and an air outlet space is formed between a front side of the heat exchanger and the front plate of the casing, and wherein the two air inlets communicate with the air inlet space, and the air outlet communicates with the air outlet space.

14. The air-conditioner unit according to claim 11, wherein a dimension in a longitudinal direction of the air-conditioner outdoor device is greater than a dimension in a vertical direction of the air-conditioner outdoor device.

15. The air-conditioner unit according to claim 11, wherein the heat exchanger is disposed within the front space.

16. The air-conditioner unit according to claim 15, wherein the air-conditioner outdoor device further comprises a fan provided within the front space, wherein the fan is located at a rear side of the heat exchanger to drive air flow to enter the front space from the two air inlets and blow the air flow towards the heat exchanger; or the fan is located at a front side of the heat exchanger to suck the air flow entering the front space from the two air inlets, so that the air flow flows through the heat exchanger and flows out of the casing from the air outlet.

17. The air-conditioner unit according to claim 11, wherein a top cover of the casing comprises a front top cover and a rear top cover, and the front top cover covers the front space, the rear top cover covers the rear space, and at least the rear top cover is openable independently.

18. A building, comprising:

a wall; and the air-conditioner outdoor device according to claim 1, wherein the casing is at least partially installed within the wall, and the front plate of the casing is substantially flush with an outer surface of the wall.

19. The building according to claim 18, comprising a support frame, wherein a portion of the casing is installed within the wall and another portion of the casing is located indoors, the portion located indoors is supported by the support frame.

* * * * *